US005374100A

United States Patent [19]

Rogers et al.

[11] Patent Number: 5,374,100

[45] Date of Patent: Dec. 20, 1994

[54] ADJUSTABLE FOLDABLE HEADREST

[75] Inventors: W. Clark Rogers, Denton; D. Stephen Hoffman, High Point, both of N.C.

[73] Assignee: Ultra-Mek, Inc., Denton, N.C.

[21] Appl. No.: 30,641

[22] Filed: Mar. 12, 1993

[51] Int. Cl.[5] ..... A47C 1/036

[52] U.S. Cl. ..... 297/61; 297/391

[58] Field of Search ..... 297/61, 391, 396, 408–410

[56] References Cited

U.S. PATENT DOCUMENTS

| | | | |
|---|---|---|---|
| 3,005,660 | 10/1961 | Winick | 297/61 |
| 3,655,241 | 4/1972 | Herzer et al. | 297/396 X |
| 3,847,430 | 11/1974 | Fletcher | 297/61 |
| 3,856,346 | 12/1974 | Herman | 297/61 |
| 3,937,518 | 2/1976 | Harrison | 297/61 |
| 3,942,835 | 3/1976 | Harrison | 297/61 |
| 4,691,961 | 9/1987 | Rogers, Jr. et al. | 297/61 |
| 4,830,429 | 5/1989 | Petitjean | 297/61 X |
| 5,145,233 | 9/1992 | Nagashima | 297/408 |

OTHER PUBLICATIONS

Drawing of *Assembly Detail for Add-On Headrest*, Parma Corporation, P.O. Box 728, Denton, N.C. 27239-0728 (1991).

*Primary Examiner*—Peter R. Brown
*Assistant Examiner*—Milton Nelson, Jr.
*Attorney, Agent, or Firm*—Bell Seltzer Park & Gibson

[57] ABSTRACT

Disclosed is a mechanism for a seating unit headrest which permits adjustment of the headrest portion relative to the remainder of the mechanism to permit use of the mechanism with seating units of different heights. Also disclosed is a mechanism which includes a flange on the rear extension link of the headrest so that only one link of the mechanism per side is visible when the chair is viewed from side or rear elevation.

22 Claims, 4 Drawing Sheets

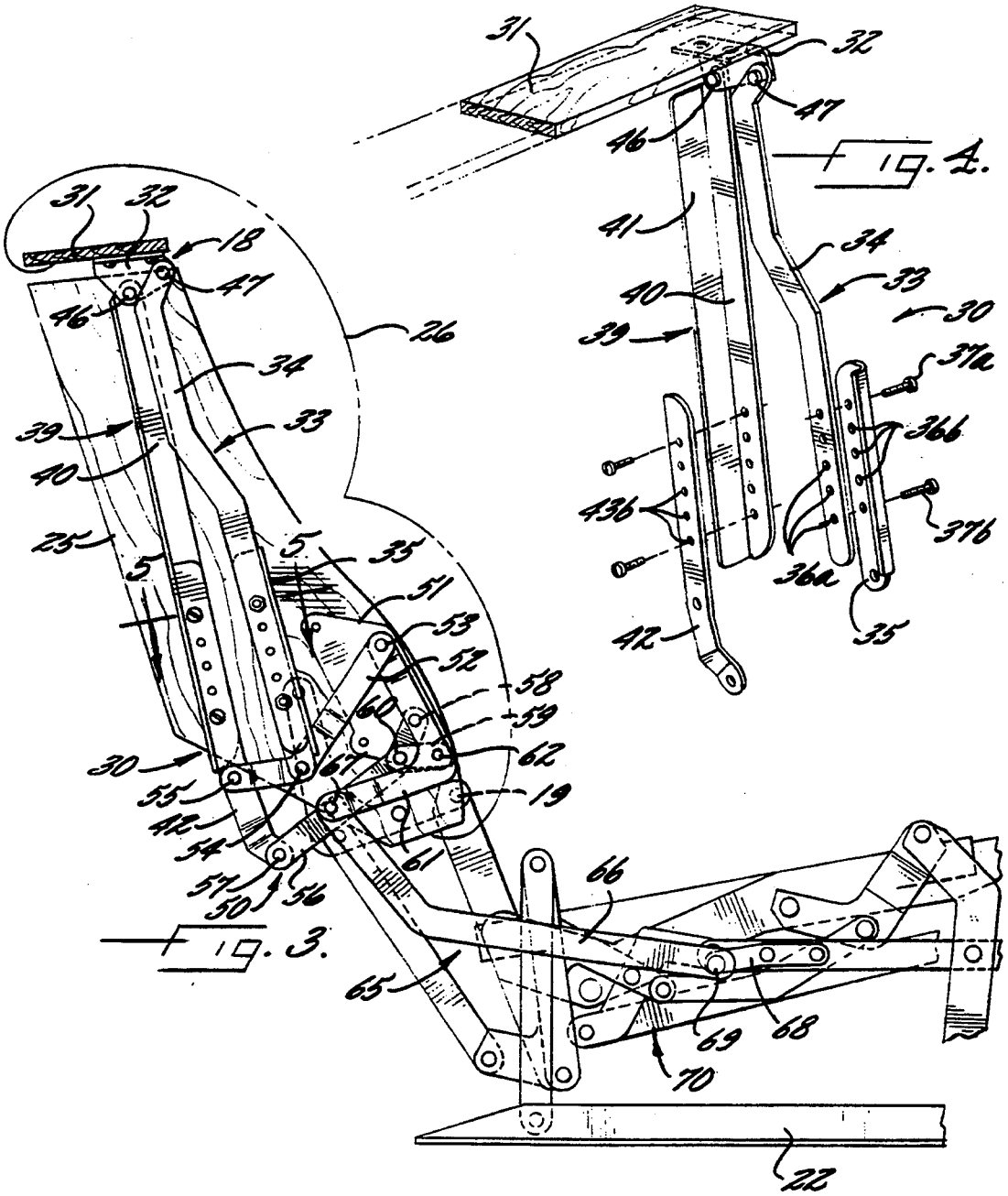
Fig. 4.
Fig. 3.
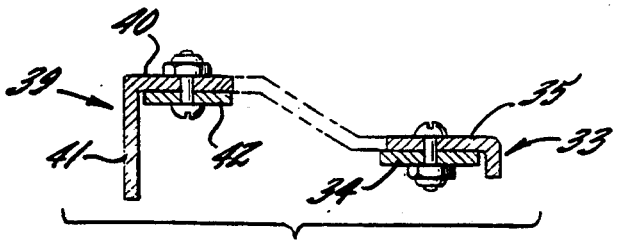
Fig. 5.

ADJUSTABLE FOLDABLE HEADREST

FIELD OF THE INVENTION

This invention relates generally to headrest assemblies for seating units, and relates more particularly to foldable headrest assemblies suitable for use with a variety of seating units having different backrest heights.

BACKGROUND OF THE INVENTION

Foldable "horizontal" headrest assemblies that rest atop the backrest of a seating unit in a generally horizontal retracted position and extend to a generally vertical position to provide a comfortable headrest are disclosed in co-pending U.S. patent application Ser. No. 07/922,627, the content of which is incorporated by reference in its entirety. While this variety of headrest provides functional and cosmetic advantages over other known headrest assemblies, two problems have been noted. First, the headrest mechanism (the series of linkages which drives the headrest from the retracted position to the extended position) is generally designed to be retrofitted to an existing seating unit model. If a manufacturer of seating units has several models to which the headrest is to be attached, he may be required to use headrest assemblies that are slightly different in configuration for each different model; this is particularly true if the different seating units have backrests of varying height. Second, although the horizontal headrest can improve the appearance of the front of the seating unit greatly by retaining the upholstery covering the backrest and headrest in a taut condition, the linkages of the headrest mechanism remain exposed when viewed from the rear of the chair. There are two links which attach to the headrest plate assembly on each side of the chair, so a total of four links are visible from the side and rear. It is desirable to redesign these links to improve their appearance and styling.

Thus it is a first object of the present invention to provide a horizontal headrest subassembly that can be used with a larger number of seating units.

It is a second object of the invention to provide a headrest subassembly configuration which improves the appearance of the horizontal headrest when the seating unit is viewed from the side or the rear.

It is a third object of the invention to provide a headrest mechanism design which is compatible with the subassemblies so provided.

SUMMARY OF THE INVENTION

These and other objects are satisfied by the present invention, which as a first aspect includes adjustable subassembly suitable for use in a mechanism for movement of a seating unit headrest between a retracted position and an extended position. The subassembly comprises a headrest mounting assembly and a an extension linkage. The extension linkage comprises a front extension link assembly and a rear extension link assembly, each of which comprises a top link having an upper end portion and a lower end portion, a lower link having an upper end portion and a lower end portion, wherein the lower end portion of the top link is fixed substantially parallel to the upper portion of the lower link, and means for adjusting the distance between the upper end portion of the top link and the lower end portion of the lower link. The lower end portion of each of the extension link assemblies is configured for pivotal attachment to an elevating linkage which causes the headrest mounting assembly to move from the retracted position, wherein the upper surface of the headrest mounting assembly is disposed generally horizontally, to the extended position, wherein the upper surface of the headrest mounting assembly faces forward and is disposed generally vertically.

A second aspect of the present invention is a subassembly suitable for use in a mechanism for movement of a seating unit headrest between a retracted position and an extended position which improves the appearance of a seating unit when viewed from the side and rear of the seating unit. The subassembly comprises a headrest mounting assembly and an extension linkage. The extension linkage comprises a front extension link pivotally interconnected with the headrest mounting assembly and a rear extension link also pivotally interconnected with the headrest mounting assembly. The rear extension link includes a flange attached to the rear edge which extends inwardly. The pivot between the rear extension link and the headrest plate assembly is positioned rearwardly and outwardly of the pivot of the front extension link and the headrest mounting assembly. The lower end portions of each of the extension links are configured for pivotal attachment to an elevating linkage which causes the headrest mounting assembly to move from the retracted position to the extended position. In the extended position, the upper end portion of the rear extension link is positioned rearward and outwardly relative to the front extension link so that the upper portion of the front extension link is hidden from view by the flange when viewed in either side or rear elevation.

A third aspect of the present invention is a headrest mechanism suitable for use in a seating unit comprising a headrest mounting assembly, an extension linkage having a front and a rear extension link, and an elevating linkage pivotally interconnected to the lower end portion of the front extension link and to the lower end portion of the rear extension link. The elevating linkage comprises mounting means adapted to be mounted to the frame of a reclining chair, a first elevating link, a second elevating link, and actuating means. The first elevating link is pivotally interconnected at one end with the mounting means, pivotally interconnected at its opposite end to the rear extension link, and intermediately pivotally interconnected to the lower end portion of said front extension link. The second elevating link is pivotally interconnected on one end with the mounting means and pivotally interconnected on its opposite end to the lower end portion of the rear extension link. The actuating means includes a control link pivotally interconnected at one end with the second elevating link intermediate of the pivots of the second elevating link with the rear elevating link and with the mounting means, and further includes a drive link pivotally interconnected with the mounting means and with the control link at the end thereof opposite the pivot between the control link and the second elevating link. Pivotal movement of the drive link causes the headrest mounting assembly to move between the retracted and the extended positions.

A fourth aspect of the present invention is a seating unit containing the mechanism just described.

BRIEF DESCRIPTION OF THE DRAWINGS

FIG. 3 is a cutaway side view of a reclining chair showing the headrest in the retracted position and reclining mechanisms in the upright position.

FIG. 4 is an exploded perspective view of the front-/and rear extension link assemblies.

FIG. 5 is a view taken along line 5—5 of FIG. 3 which shows the spatial relationship of the front and rear extension links.

DETAILED DESCRIPTION OF THE INVENTION

The present invention will now be described more fully hereinafter. This invention may be embodied in many forms and should not be construed as limited to the embodiment set forth herein; instead, this embodiment is provided so that this disclosure will be thorough and complete, and will fully convey the scope of the invention to those skilled in the art.

The following definitions of terms known in this art will facilitate a more complete understanding of the invention. As used herein, "upright position" means the position of an unoccupied recliner chair, with the backrest in its most upright position and with the footrest retracted beneath the seat. "Fully reclined position" means the position of a recliner chair in which the backrest has been reclined to its shallowest angle relative to the floor. "TV position" means an intermediate reclined position for a recliner chair in which the footrest is projected forwardly from the chair while the backrest is in an upright or a substantially upright position. A "one-way" recliner means a chair which includes a seat and backrest rigidly fixed to one another, and which is movable between an upright and a fully reclined position. A "two-way" recliner means a recliner chair which includes a seat and backrest which are rigidly fixed to each other and which is movable between an upright position, a TV position, and a fully reclined position. A "three-way" recliner means a recliner chair for which the backrest may pivot into reclining positions relative to the seat, which also is capable of moving into reclining positions relative to a fixed base, the angle between the backrest and seat being variable in different reclining positions, and which is movable between an upright position, a TV position, and a fully reclined position. A "wall-avoiding" recliner means a type of recliner chair wherein, as the chair moves to a reclining position, the backrest of the chair also moves forwardly, so that if the backrest of the chair is placed substantially adjacent a wall, the backrest will not strike the wall during reclining or retraction of the chair.

Figure 1:
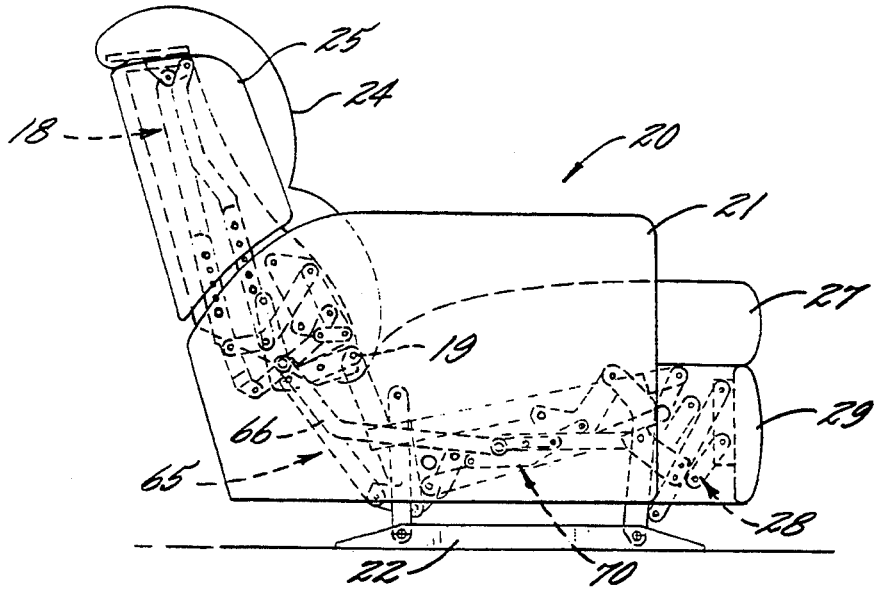
FIG. 1 is a side elevation view of a three-way reclining chair in the upright position.
Figure 2:
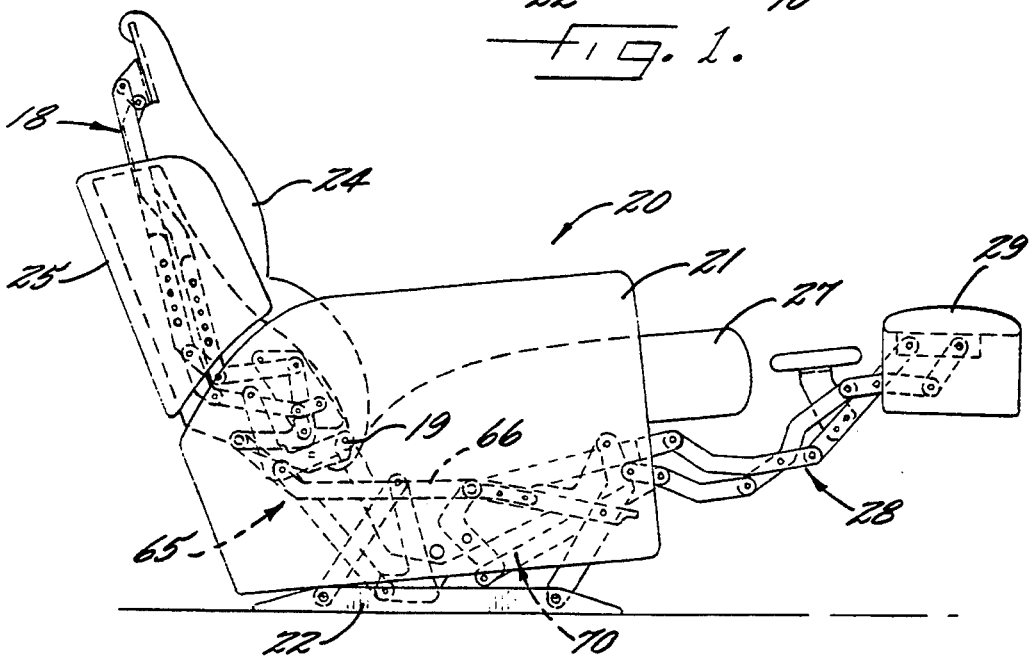
FIG. 2 is a side elevation view of a three-way reclining chair in TV position with the headrest extended.

Referring now to the drawings, a three-way reclining chair designated generally at 20 is shown in FIG. 1. The chair 20 comprises a seat frame 21, a base 22 which supports the seat frame 21, and an adjustable horizontal headrest mechanism 18. The seat frame 21 comprises a seat 27, a footrest 29 attached to the chair by a footrest extension linkage 28, and a backrest 24. As this is a three-way recliner, the backrest 24, which includes a pair of side panels 25 (FIG. 3), is pivotable about the seat 27 at pivot 19 so that the chair is movable between an upright position shown in FIG. 1, an intermediate TV position shown in FIG. 2, and a fully reclined position (not shown). The movement of the seat 27 and the backrest 24 relative to one another and to the base 22 is controlled by a reclining linkage 70 which pivotally interconnects the seat frame 21 to the base 22. The footrest 29 is movable through actuation of the footrest linkage 28 between a retracted position beneath the seat 27 (in the upright position shown in FIG. 1) and an extended position forward of the seat 27 (in the TV position shown in FIG. 2 and the fully reclined position). Although a wall-avoiding three-way reclining chair is shown, those skilled in this art will recognize that the headrest mechanism 18 is suitable for use in non-reclining seating units and reclining seating units, including one-way, two-way, and three way recliners of both wall-avoiding and non-wall avoiding types, and can further be used with models that include a mechanism providing a rocking action.

Figure 6:
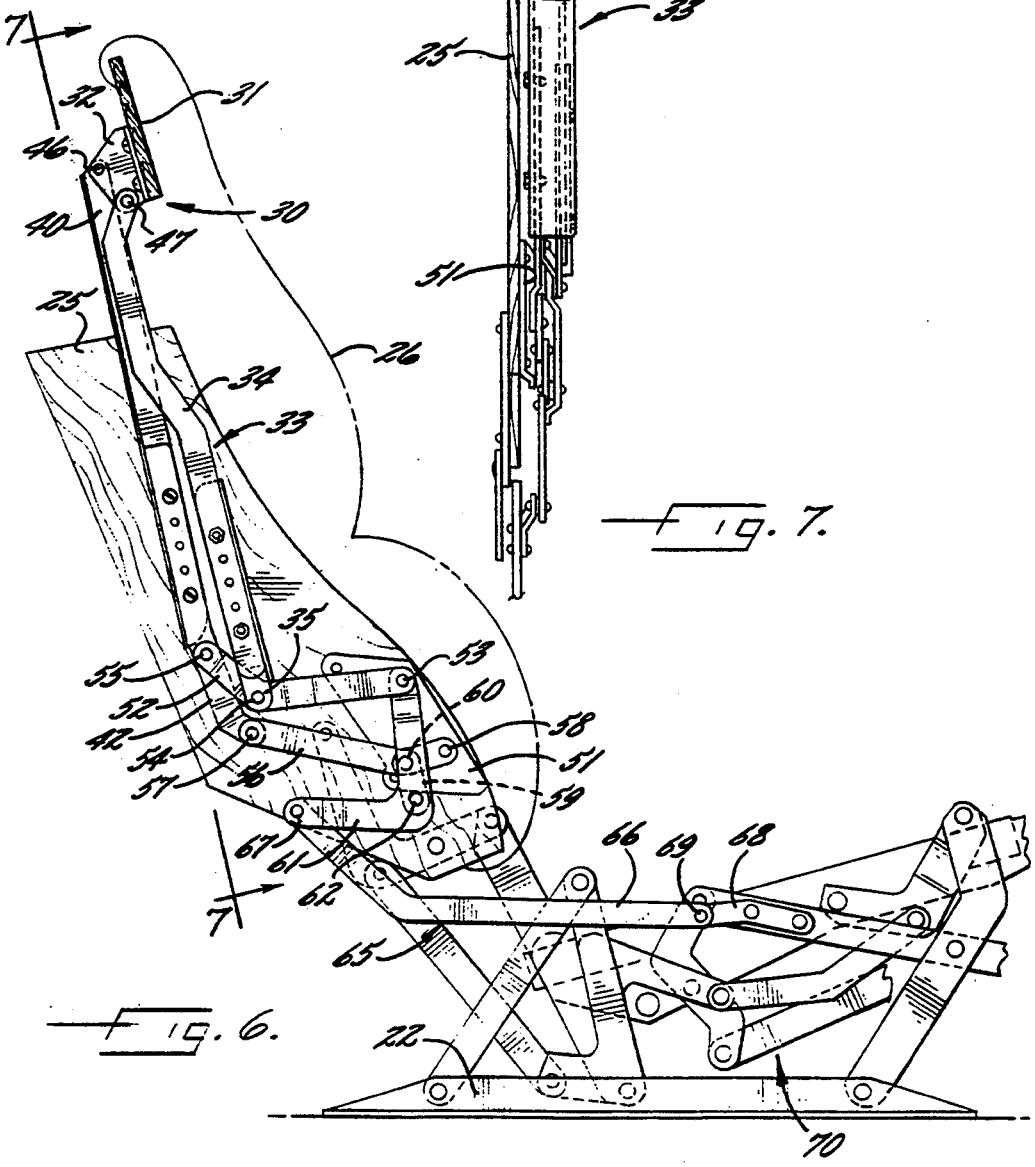
FIG. 6 is a cutaway side view of a reclining chair showing the headrest in the extended position and the reclining mechanism in the TV position.
Figure 8:
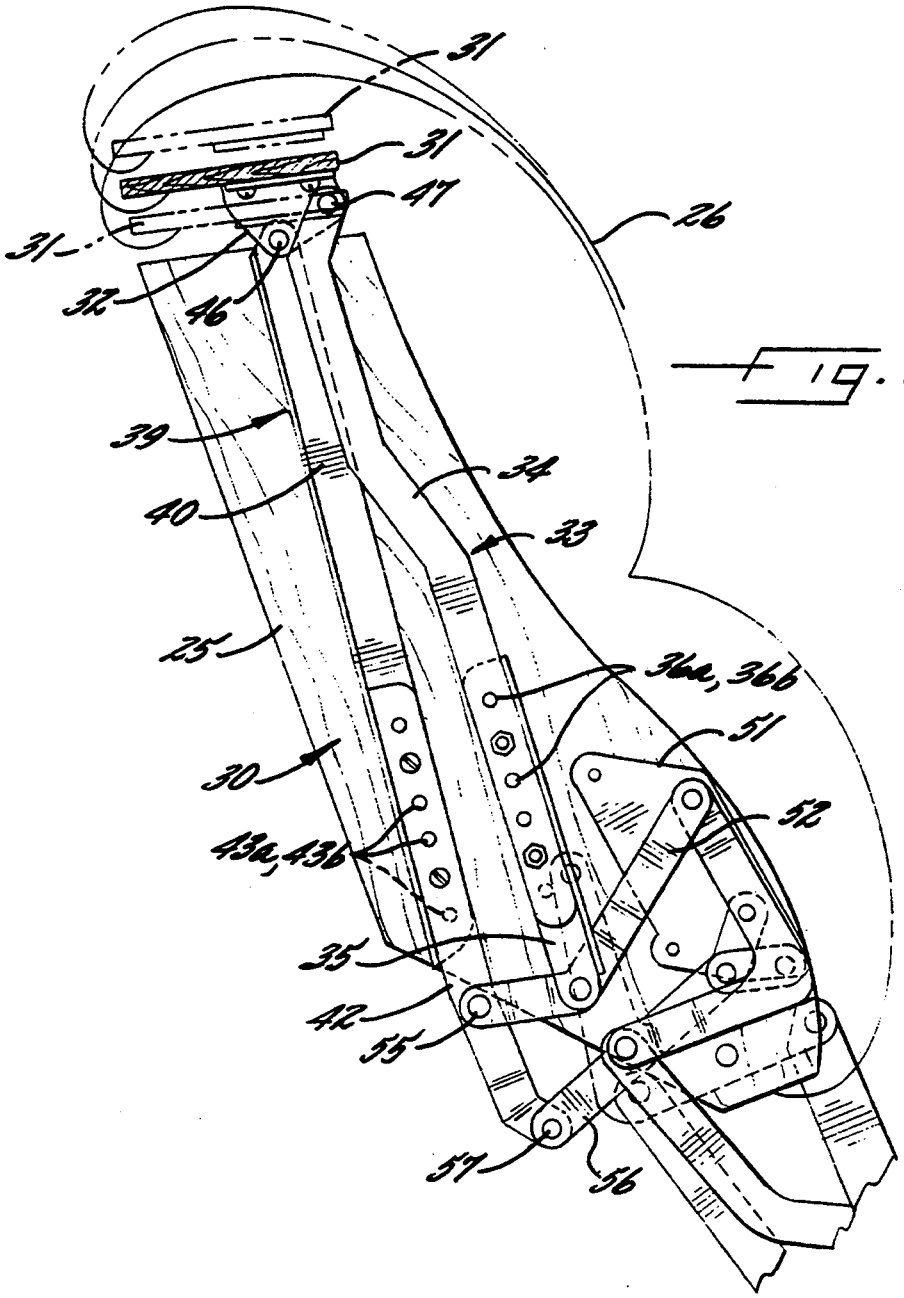
FIG. 8 is a side cutaway view of a reclining chair showing how the adjustability of the front and rear extension links permits the headrest assembly to be used with seating units having backrests of different heights.

The adjustable headrest mechanism 18, shown best in FIGS. 3, 6 and 8, comprises a headrest mounting assembly 30, a pair of actuating units 50, and a pair of mounting plates 51. The actuating units 50 and mounting plates 51 are mirror images of each other; for clarity of explanation, only one of each will be described in detail. A single piece of upholstery fabric 26 covers the headrest mounting assembly 30 and the front surface of the backrest 24; the upholstery fabric 26 is fixed to the lower rear edge of a headrest plate 31 and beneath the front lower edge of the backrest 24 and is sized to remain taut as it covers the front surfaces of the backrest 24 and the headrest plate 31. Those skilled in this art will appreciate that this invention is also suitable for use with multiple upholstery pieces separately covering the backrest 24 and the headrest mounting assembly 30.

Figure 7:
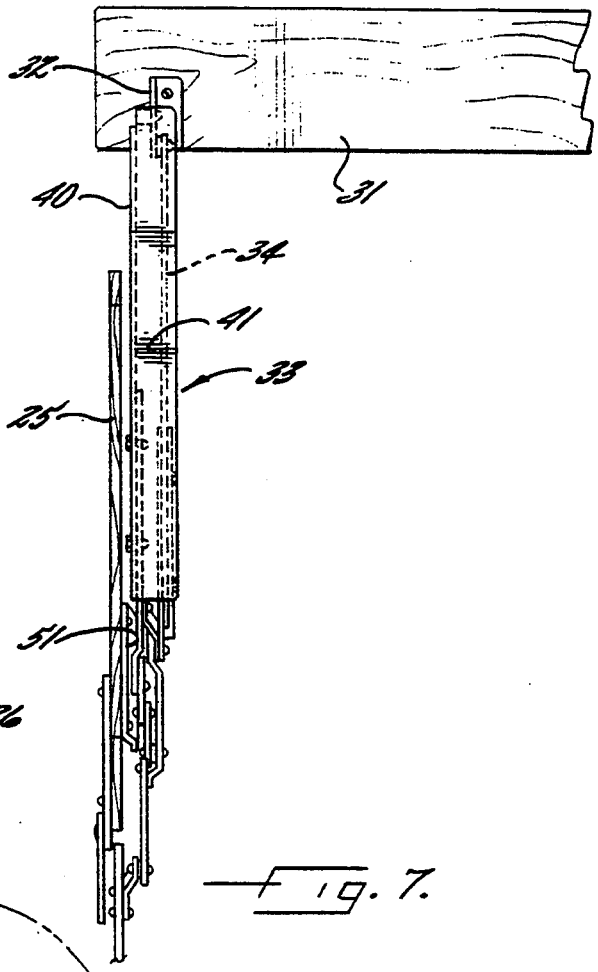
FIG. 7 is a rear elevation view taken along line 7—7 of FIG. 6 showing the headrest mechanism in the extended position.

The mounting plate 51 is fixed to the interior of the backrest side panel 25 of the backrest 24 (FIG. 7). The mounting plate 51 includes apertures for pivots 53 and 58 near its forward edge. Those skilled in this art will appreciate that any type of mounting means, such as the mounting of pivot points of the actuating unit 50 directly to the backrest side panel 25, which fixes these pivot points to the appropriate locations on the backrest side panel 25 are suitable for use with the invention.

The headrest mounting assembly 30 comprises a headrest plate 31, a mounting bracket 32 fixed to the underside of the headrest plate 31, a front extension link assembly 33, and a rear extension link assembly 39. The mounting bracket 32 includes pivots 46 and 47 which pivotally connect the mounting bracket to, respectively, the upper portions of the rear and front extension link assemblies 33, 39. Pivot 46 is located slightly downwardly and rearwardly of pivot 47. The headrest plate 31 is sized to be visually integrated with the upper edge of the backrest 24.

The front extension link assembly 33 comprises a top link 34, which is pivotally interconnected at its upper portion to the mounting bracket 32 at pivot 47, and a lower link 35. The top link 34 includes in its lower portion apertures **36*a* which are positioned linearly substantially parallel with the length of the top link and which are regularly spaced. Similarly, the lower link 35 includes apertures 36*b* in its upper portion which are positioned linearly substantially parallel with the length of the lower link 35; each aperture 36***b* can be aligned with at least one of the apertures 36*a* of the top link 34. The lower link 35 is adjustably fixed to the top link 34 through alignment of an aperture 36*a* with an aperture 36*b* and insertion of bolts 37*a*, 37*b*, which are fastened in place with bolts 38*a*, 38*b*.

The rear extension link assembly 39 comprises a top link 40, which is pivotally interconnected at its upper portion to the mounting bracket 32 at pivot 46, and a lower link 42. The top link includes on its rear exterior edge a flange 41 (seen in FIGS. 5 and 7) running the length of the top link 40 which extends inwardly substantially perpendicularly to the remainder of the top link 40. The top link 40 includes in its lower portion apertures 43*a* which are positioned linearly substantially parallel with the length of the top link and which are regularly spaced. Similarly, the lower 40 link 42 includes in its upper portion apertures 43*b* which are positioned linearly substantially parallel with the length of the lower link 42; each aperture 43*b* can be aligned with at least one of the apertures 43*a* of the top link 40. The lower link 42 is adjustably fixed to the top link 40 through alignment of an aperture 43*a* with an aperture 43*b* and insertion of bolts 44*a*, 44*b*, which are fastened with nuts 45*a*, 45*b*.

FIG. 8 illustrates how the headrest mounting assembly 30 can be used with seating units having backrests of different heights. In seating units the headrest plate 31 will be disposed in a generally horizontal position atop the backrest 24 in the retracted position. By adjusting the position of the top link 34 of the front extension link assembly 33 relative to the lower link 35 so that a different pair of apertures 36*a* and 36*b* align, the total length of the front extension link assembly 33 (i.e., the distance between the upper portion of the top link 34 and the lower portion of the lower link 35) can be altered. Similarly, the length of the rear extension link assembly can be adjusted by repositioning the top link 40 relative to the lower link 42 so that a different pair of apertures 43*a* and 43*b* align. Those skilled in this art will appreciate that, although a cooperative combination of apertures and threaded fasteners are illustrated in this embodiment, any means which permits the position of the top link of each extension link assembly to be raised or lowered relative to the lower link and which permits the links so positioned to be fixed relative to one another, such as apertures and pins, pressure clamps, adhesives, and the like, is suitable for use with this invention.

Exemplary of an alternative configuration for the adjusting the length of the extension link assemblies is one which comprises a single aperture on the lower link which can align with one of a series of apertures in the upper link. In this configuration, the apertures and the insertable pin member (e.g., the bolt 37*a*) should be non-round, i.e., square, rectangular, ovoid, or the like, in order to prevent pivotal movement of the top link about the lower link. Alternatively, a round aperture and pin member can be used in conjunction with a stop means, such as the flange 41, which restricts pivotal movement of the upper link about the lower link. In a further embodiment, the lower link can include one or more pin members fixed to the upper portion of the lower link which are insertable into the series of apertures in the upper link. Those skilled in this art will appreciate that any of the configurations described above can be reversed, (e.g., with the single aperture in the upper link and the series of apertures in the lower link) and be equally suitable. Further, any series of apertures need not be regularly spaced as shown herein, but can be arranged in some other pattern or even irregularly and still provide an operable embodiment of the invention.

The actuating assembly 50 (FIG. 3) comprises an upper elevating link 52, a lower elevating link 56, a control link 59, and a drive link 61. The upper elevating link 52 is pivotally interconnected at its forwardmost end to the mounting plate 51 at pivot 53 and is pivotally interconnected at its other end to the lower link 42 of the rear extension link assembly 39 at pivot 55. Intermediate of pivots 55 and 53, the upper elevating link 52 is pivotally interconnected at pivot 54 to the lower portion of the lower link 35 of the front extension link assembly 33. The lower elevating link 56 is pivotally interconnected at its forwardmost end to the mounting plate 51 at pivot 58 and is also pivotally interconnected at its rearmost end to the lower end of lower link 42 of rear extension link assembly 39 at pivot 57. The control link 59 is pivotally attached at one end to the lower elevating link 56 at pivot 60, which is intermediate of pivots 57 and 58 on the lower elevating link 56. The L-shaped drive link 60 is pivotally attached at one to the mounting plate 51 at pivot 53, is further pivotally interconnected at approximately its vertex to the control link 59 at pivot 62, and is pivotally interconnected at its other end to a coupling mechanism 65 at pivot 67.

The coupling mechanism 65 comprises a reclining drive link 66, which attaches at its rearmost end to the drive link 66 at pivot 67, and a coupling bracket 68, which is pivotally interconnected at its rearmost end to the forwardmost end of the drive link 66 at pivot 69 and is fixed at its forward end to the reclining mechanism 70. Those skilled in this art will appreciate that any number of means are known for responsively coupling the actuation of the headrest mechanism 30 to the movement of the reclining mechanism 70 as it moves the chair 20 from the upright position to the TV position. An exemplary mechanism is seen in U.S. Pat. No. 4,544,201 to Rogers.

The headrest assembly 18 is actuated from its retracted position (FIG. 3) to its extended position (FIG. 6) in response to movement of the reclining linkage 70 from upright to TV position, which activates the reclining drive link 66. As the reclining drive link 66 moves from its lowered position in FIG. 3 to its slightly rearward and raised position of FIG. 6, the reclining drive link 66 pushes the drive link 61 upward and rearward about pivot 53. This rotation of the drive link 61 causes the control link 59 to rotate about pivot 60 so that pivot 62 moves rearwardly and slightly downwardly. This action causes the control link 59 to force the lower elevating link 56 to pivot about pivot 58 so that its rearmost end, which includes pivot 57, rises. The ascension of the lower elevating link 56 causes the rear extension link assembly 39 to rise accordingly. Upward movement of the rear extension link assembly 39 draws the rearmost end of the upper elevating link 52 upwardly, which in turn raises the front extension link assembly 33 substantially parallel to the rear extension link 39 and to the profile of the backrest 24. The action of the front and rear extension link assemblies 33, 39 lifts the headrest assembly 31 from its retracted horizontal position overlying the upper edge of the backrest 24. Because the distance between pivot 54, which attaches the front extension link assembly 33 to the upper elevating link, and pivot 53 is less than the distance between pivot 59, which attaches the rear extension link assembly 39 to the lower elevating link 56, and pivot 58, the rear extension link assembly 39 rises slightly more than the front extension link assembly 33. As a result, the pivot 46 rises slightly more than the pivot 47, which action forces the headrest plate 31 to tilt from horizontal toward vertical as it rises. The headrest plate 31 reaches its fully extended position as it is disposed generally upright and substantially parallel to the profile of the backrest 24 (FIG. 6).

It will he appreciated by those skilled in this art that any means attached to the drive link 61 which causes the drive link 61 to move as described is suitable for use with this invention. Exemplary is a manually operated handle or knob assembly attached, directly or through a linkage unit, to the drive link 61 that is also attached to the exterior of the chair 20.

FIG. 7 illustrates how the present invention improves the appearance of the seating unit. In the extended position shown in FIG. 7, the flange 41 of the top link 40 of the rear extension link assembly 39 prevents one viewing the unit from the rear from seeing the front extension link assembly 33; therefore only one link is visible, which provides the chair 20 with a sleeker, more modern appearance. It will be apparent to those skilled in this art that to achieve this appearance, the flange 41 must extend inwardly at least as far as the inwardmost edge of the top link 34 of the front extension link assembly 33. Preferably, this distance is between about 0.2 and 2 inches. Further, one viewing the chair in side elevation is also able to see only the top link 40 of the rear extension link assembly 39, as the top link 40 extends forwardly sufficiently to obscure any view of the top link 34 of the front extension link assembly 33. As described above, the visibility of only a single link provides the chair 20 with a more modern appearance. In this embodiment, the flange 41 is shown to extend as a flat plane extending inwardly substantially perpendicularly to the top link 40. However, the flange can extend to some degree forward or rearward of perpendicular to the top link 40 and remain operable. Further, the flange 41 need not be planar, but instead can take a variety of elongated profiles, including semi-circular, semi-elliptical, angled, curvilinear, and the like, as long as the inward extension is sufficient to hide the front upper link 39 from view when viewed in rear elevation (as in FIG. 7).

The foregoing embodiments are illustrative of the present invention, and are not to be construed as limiting thereof. The invention is defined by the following claims, with equivalents of the claims to be included therein.

That which is claimed is:

1. A subassembly suitable for use in a mechanism for movement of a seating unit headrest between a retracted position and an extended position, said subassembly comprising:

(a) a headrest plate having an upper surface; and (b) an extension linkage comprising:

(i) a front extension link assembly comprising a top link having an upper end portion and a lower end portion, a lower link having an upper end portion and a lower end portion, said lower end portion of said top link being fixed substantially parallel to said upper end portion of said lower link, and means for adjusting the distance between said upper end portion of said top link and said lower end portion of said lower link, said upper end portion of said top link being pivotally interconnected with said headrest plate; and (ii) a rear extension link assembly comprising a top link having an upper end portion and a lower end portion, a lower link having an upper end portion and a lower end portion, said lower end portion of said rear extension link assembly top link being fixed substantially parallel to said upper end portion of said rear extension link assembly lower link, and means for adjusting the distance between said upper end portion of said rear extension link assembly top link and said lower end portion of said rear extension link assembly lower link, said upper end portion of said rear extension link assembly top link being pivotally interconnected to said headrest plate rearward of said pivot of said front extension link assembly and said headrest plate;

the lower end portions of each of said extension link assemblies being configured for pivotal attachment to an elevating linkage which causes said headrest plate to move from the retracted position, wherein said upper surface of said headrest plate is disposed generally horizontally, to the extended position, wherein said upper surface of said headrest plate faces forward and is disposed generally vertically.

2. A subassembly according to claim 1, wherein said adjusting means for said front extension link assembly comprises:

(a) said lower end portion of said front extension link assembly top link having a plurality of apertures and said upper end portion of said front extension link assembly lower link having at least one aperture, said at least one aperture of said front extension link assembly lower link being alignable with at least one of said plurality of apertures of said front extension link assembly top link, and (b) at least one pin member inserted through at least one of said plurality of apertures of said front extension link assembly top link and further inserted through said at least one aperture of said front extension link assembly lower link to reversibly fix said front extension link assembly lower link to said front extension link assembly top link; and and wherein said adjusting means for said rear extension link assembly comprises:

(c) said lower end portion of said rear extension link assembly top link having a plurality of apertures and said upper end portion of said rear extension link assembly lower link having at least one aperture, said at least one aperture of said rear extension link assembly lower link being alignable with at least one of said plurality of apertures of said rear extension link assembly top link, and (d) at least one pin member inserted through at least one of said plurality of apertures of said rear extension link assembly top link and further inserted through said at least one aperture of said rear extension link assembly lower link to reversibly fix said rear extension link assembly lower link to said rear extension link assembly top link.

3. A subassembly according to claim 1, wherein said adjusting means for said front extension link assembly comprises:

(a) said lower end portion of said front extension link assembly top link having at least one aperture and said upper end portion of said front extension link assembly lower link having a plurality of apertures, each of said plurality of apertures of said front extension link assembly lower link being alignable with said at least one aperture of said front extension link assembly top link, and (b) at least one pin member inserted through said at least one aperture of said front extension link assembly top link and further inserted through at least one of said plurality of apertures of said front extension link assembly lower link to reversibly fix said front extension link assembly lower link to said front extension link assembly top link; and and wherein said adjusting means for said rear extension link assembly comprises:

(c) said lower end portion of said rear extension link assembly top link having at least one aperture and said upper end portion of said rear extension link assembly lower link having a plurality of apertures, each of said plurality of apertures of said rear extension link assembly lower link being alignable with said at least one aperture of said rear extension link assembly top link, and (d) at least one pin member inserted through said at least one aperture of said rear extension link assembly top link and further inserted through at least one of said plurality of apertures of said rear extension link assembly lower link to reversibly fix said rear extension link assembly lower link to said rear extension link assembly top link.

4. A subassembly according to claim 1, wherein said adjusting means for said rear extension link assembly comprises:

(a) said lower end portion of said rear extension link assembly top link having an aperture and said upper end portion of said rear extension link assembly lower link having an aperture, said aperture of said rear extension link assembly lower link being alignable with said aperture of said rear extension link assembly top link;

(b) a pin member inserted through said aperture of said rear extension link assembly top link and further inserted through said aperture of said rear extension link assembly lower link; and (c) a flange attached to said upper end portion of said rear extension link assembly top link, said flange extending inwardly and further extending downwardly so as to contact said upper end portion of said lower link of said rear extension link assembly and thereby provide support thereto.

5. A subassembly according to claim 1, wherein said adjusting means for said front extension link assembly comprises:

(a) said lower end portion of said front extension link assembly top link having a plurality of apertures and said upper end portion of said front extension link assembly lower link having a plurality of apertures, at least one of said plurality of apertures of said front extension link assembly lower link being alignable with at least one of said plurality of apertures of said front extension link assembly top link, and (b) at least one pin member inserted through at least one of said plurality of apertures of said front extension link assembly top link and further inserted through at least one of said plurality of apertures of said front extension link assembly lower link to reversibly fix said front extension link assembly lower link to said front extension link assembly top link; and wherein said adjusting means for said rear extension link assembly comprises:

(c) said lower end portion of said rear extension link assembly top link having a plurality of apertures and said upper end portion of said rear extension link assembly lower link having a plurality of apertures, at least one of said plurality of apertures of said rear extension link assembly lower link being alignable with at least one of said plurality of apertures of said rear extension link assembly top link, and (d) at least one pin member inserted through at least one of said plurality of apertures of said rear extension link assembly top link and further inserted through at least one of said plurality of apertures of said rear extension link assembly lower link to reversibly fix said rear extension link assembly lower link to said rear extension link assembly top link.

6. A subassembly suitable for use in a mechanism for movement of a seating unit headrest having a headrest plate between a retracted position and an extended position, said subassembly comprising:

(a) a headrest plate having an upper surface; and (b) an extension linkage comprising:

(i) a front extension link having an upper end portion and a lower end portion, said upper end portion being pivotally interconnected with said headrest plate; and (ii) a rear extension link having an upper end portion, a lower end portion, a rear edge and a flange, said flange being attached to said rear edge and extending inwardly, said rear extension link upper end portion being pivotally interconnected to said headrest plate rearward of said pivot of said front extension link and said headrest plate;

the lower end portions of each of said extension links being configured for pivotal attachment to an elevating linkage which causes said headrest plate to move from the retracted position, wherein said upper surface of the headrest plate is disposed generally horizontally, to the extended position, wherein said upper surface of said headrest plate faces forward and is disposed generally vertically, and wherein said upper end portion of said rear extension link is positioned rearward and outwardly relative to said front extension link so that, in the extended position, said upper end portion of said front extension link is hidden from view by said flange when viewed in side elevation and when viewed in rear elevation.

7. A subassembly according to claim 6, wherein said flange extends inwardly from said rear extension link between about 0.2 and 2 inches.

8. A subassembly according to claim 6, wherein said front extension link comprises:

(a) a front extension link top link having an upper end portion and a lower end portion, (b) a front extension link lower link having an upper end portion and a lower end portion, said lower end portion of said front extension link top link being fixed substantially parallel to said upper end portion of said front extension link lower link, and (c) means for adjusting the distance between said upper end portion of said front extension link top link and said lower end portion of said front extension link lower link;

and wherein said rear extension link comprises:

(d) a top link having an upper end portion and a lower end portion, (e) a lower link having an upper end portion and a lower end portion, said lower end portion of said rear extension link top link being fixed substantially parallel to said upper portion of said rear extension link lower link, and (f) means for adjusting the distance between said upper end portion of said rear extension link top link and said lower end portion of said rear extension link lower link, said upper end portion of said rear extension link top link being pivotally interconnected to said headrest plate rearward of said pivot of said front extension link assembly and said headrest plate.

9. A headrest mechanism suitable for use in a seating unit comprising:

(a) a headrest plate having an upper surface movable between a first generally horizontal retracted position and a second generally upright extended position;

(b) an extension linkage comprising:

(i) a front extension link having an upper end portion and a lower end portion and being pivotally interconnected at said upper end portion to said headrest plate; and (ii) a rear extension link having an upper end portion and a lower end portion and being pivotally interconnected at upper end portion to said headrest plate rearward of said pivot between said front extension link and said headrest plate; and (c) an elevating linkage pivotally interconnected to said lower end portion of said front extension link and to said lower end portion of said rear extension link, said elevating linkage comprising:

(i) mounting means adapted to be mounted to the frame of a reclining chair;

(ii) a first elevating link pivotally interconnected at one end with said mounting means, pivotally interconnected at its opposite end to said rear extension link, and intermediately pivotally interconnected to said lower end portion of said front extension link;

(iii) a second elevating link pivotally interconnected on one end with said mounting means and pivotally interconnected on its opposite end with said lower end portion of said rear extension link; and (iv) means for actuating the headrest mechanism including:

(A) a control link pivotally interconnected at one end with said second elevating link intermediate of said pivots of said second elevating link with said rear extension link and with said mounting means; end (B) a drive link pivotally interconnected with said mounting means and further pivotally interconnected with said control link at the end thereof opposite said pivot between said control link and said second elevating link, so that pivotal movement of said drive link about said mounting means, in which the end of said drive link opposite said drive link end that is pivotally interconnected with said mounting means moves upward and rearward, causes said headrest plate to move from the retracted position, in which said upper surface is generally horizontally disposed, to the extended position, in which said upper surface faces forward and is generally vertically disposed.

10. A mechanism according to claim 9, wherein said front extension link comprises:

(a) a top link having an upper end portion and a lower end portion, (b) a lower link having an upper end portion and a lower end portion, said lower end portion of said front extension link top link being fixed substantially parallel to said upper end portion of said front extension link lower link, and (c) means for adjusting the distance between said upper end portion of said front extension link top link and said lower end portion of said front extension link lower link;

and wherein said rear extension link comprises:

(d) a top link having an upper end portion and a lower end portion, (e) a lower link having an upper end portion and a lower end portion, said lower end portion of said rear extension link top link being fixed substantially parallel to said upper end portion of said rear extension link lower link, and (f) means for adjusting the distance between said upper end portion of said rear extension link top link and said lower end portion of said rear extension link lower link, said upper end portion of said rear extension link top link being pivotally interconnected to said headrest plate rearward of said pivot of said front extension link and said headrest plate.

11. A mechanism according to claim 9, wherein said pivots between (a) said first elevating link and said mounting means and (b) said drive link and said mounting means share a common pivotal interconnection on said mounting means.

12. A mechanism according to claim 9, wherein said drive link is configured for pivotal interconnection with and movement responsive to a reclining mechanism for a reclining seating unit, so that reclining movement of the seating unit would cause movement of said headrest plate from the retracted position to the extended position.

13. A seating unit comprising:

(a) a seat frame including a backrest, a seat, and a base;

(b) a headrest plate having an upper surface movable between a first generally horizontal retracted position and a second generally vertical extended position;

(c) a pair of mechanisms fixedly attached to said backrest for moving said headrest plate between the retracted and the extended positions, each of said pair of mechanisms comprising:

(i) an extension linkage comprising:

(A) a front extension link having an upper end portion and a lower end portion and being pivotally interconnected at its upper end portion to said headrest plate; and (B) a rear extension link having an upper end portion and a lower end portion and being pivotally interconnected at its upper end portion to said headrest plate rearward of said pivot between said front extension link and said headrest plate; and (ii) an elevating linkage pivotally interconnected to said lower end portion of said front extension link and to said lower end portion of said rear extension link, said elevating linkage comprising:

(A) mounting means fixedly mounted to said backrest of said seating unit;

(B) a first elevating link pivotally interconnected at one end with said mounting means, pivotally interconnected at its opposite end to said rear extension link, and intermediately pivotally interconnected to said lower end portion of said front extension link;

(C) a second elevating link pivotally interconnected on one end with said mounting means and pivotally interconnected on its opposite end to said lower end portion of said rear extension link; and (iv) means for actuating the mechanism including:

(A) a control link pivotally interconnected at one end with said second elevating link intermediate of said pivots of said second elevating link with said rear extension link and with said mounting means; and (B) a drive link pivotally interconnected with said mounting means and further pivotally interconnected with said control link at the end thereof opposite said pivot between said control link and said second elevating link, so that pivotal movement of said drive link about said mounting means, in which the end of said drive link opposite its pivot with said mounting means moves upward and rearward, causes said headrest plate to move from the retracted position, in which said upper surface is generally horizontally disposed, to the extended position, in which said upper surface is generally vertically disposed.

14. A seating unit according to claim 13, wherein each of said pair of front extension links and said pair of rear extension links each include means for adjusting the distance between each of said upper end portions and each of said lower end portions.

15. A seating unit according to claim 13, wherein each said front extension link comprises:

(a) a top link having an upper end portion and a lower end portion, (b) a lower link having an upper end portion and a lower end portion, said lower end portion of said front extension link top link being fixed substantially parallel to said upper portion of said front extension link lower link, and (c) means for adjusting the distance between said upper end portion of said front extension link top link and said lower end portion of said front extension link lower link;

and wherein said rear extension link comprises:

(d) a top link having an upper end portion and a lower end portion, (e) a lower link having an upper end portion and a lower end portion, said lower end portion of said rear extension link top link being fixed substantially parallel to said upper end portion of said rear extension link lower link, and (f) means for adjusting the distance between said upper end portion of said rear extension link top link and said lower end portion of said rear extension link lower link, said upper end portion of said rear extension link top link being pivotally interconnected to said headrest plate rearward of said pivot of said front extension link and said headrest plate.

16. A seating unit according to claim 13, wherein said pivot between said first elevating link and said mounting means and said drive link and said mounting means share a common pivotal interconnection on said mounting means.

17. A seating unit according to claim 13, wherein said rear extension link has a rear edge and a flange, said flange being attached to said rear edge and extending inwardly, said rear extension link upper end portion being pivotally interconnected to said headrest plate rearward of said pivot of said front extension link and said headrest plate;

the lower end portions of each of said extension links being configured for pivotal attachment to said elevating linkage, and wherein said upper end portion of said rear extension link is positioned rearward and outwardly relative to said front extension link so that said upper portion of said front extension link is hidden from view by said flange when viewed in side elevation and when viewed in rear elevation.

18. A seating unit according to claim 13, wherein said frame further includes a footrest movable between a retracted vertical position below said seat and an extended horizontal position forward of said seat, and wherein said seating unit further comprises:

(a) reclining linkage means for coordinating movement of said backrest, said seat, and said footrest relative to said base so that when said seating unit is in a first upright position, said backrest is in an upright position and said footrest is in its retracted position, and when said seating unit is in a reclined position, said backrest and said seat are in a reclined position, and said footrest is in its extended position; and (b) means for responsively coupling the movement of said headrest plate to said reclining linkage means so that when said seating unit is in its first upright position, said headrest plate is in its retracted position, and when said seating unit is in a reclined position, said headrest plate is in its extended position.

19. The seating unit defined in claim 18, wherein said reclining linkage means further comprises linkage wall avoiding means for limiting the rearward movement of upper edge of said backrest relative to said base as said seating unit moves from the upright position to the reclined position.

20. The seating unit defined in claim 18, wherein said reclining linkage means further comprises means for reclining said seat and said backrest to a plurality of reclined positions, and wherein said responsive coupling means further comprise means responsive to said reclining linkage means for maintaining the extended position of said headrest when said seating unit is in any of the plurality of reclined positions.

21. The seating unit defined in claim 20, wherein said reclining linkage means comprises linkage means for reclining said seat frame to a TV position and for further reclining said seat frame to a fully reclined position.

22. The seating unit defined in claim 21, wherein said backrest is pivotable about said seat so that when said seating unit is in the first upright position, when viewed from side elevation, said backrest and said seat define a first angle, and when said seating unit is in the fully reclined position, said seat and said backrest define a second angle different from said first angle.

* * * * *

UNITED STATES PATENT AND TRADEMARK OFFICE

CERTIFICATE OF CORRECTION

PATENT NO. : 5,374,100

DATED : December 20, 1994

INVENTOR(S) : Rogers, et al.

It is certified that error appears in the above-identified patent and that said Letters Patent is hereby corrected as shown below:

Col. 5, line 16, after "link" and before "and", please insert -- 40 --.

Col. 5, line 17, after "lower", please delete "40".

Col. 6, line 23, please delete "60" and insert -- 61 --.

Col. 6, line 30, please delete "66" and insert -- 61 --.

Column 11

Claim 9, line 56, please delete "end" and insert -- and --.

Signed and Sealed this

Eighteenth Day of February, 1997

Bruce Lehman

*Attest:*

BRUCE LEHMAN

*Attesting Officer*

*Commissioner of Patents and Trademarks*